US005669369A

United States Patent [19]

Scott

[11] Patent Number: 5,669,369

[45] Date of Patent: Sep. 23, 1997

[54] PAINT BALL GUN AND ASSEMBLIES THEREFOR

[76] Inventor: Eric Scott, 15695 92nd Way N., Jupiter, Fla. 33478

[21] Appl. No.: 607,134

[22] Filed: Feb. 26, 1996

Related U.S. Application Data

[63] Continuation of Ser. No. 972,619, Nov. 6, 1992, Pat. No. 5,494,024.

[51] Int. Cl.[6] ..... F41B 11/32; F41B 11/06

[52] U.S. Cl. ..... 124/73; 124/74

[58] Field of Search ..... 124/56, 70–74, 124/76; 137/505.25

[56] References Cited

U.S. PATENT DOCUMENTS

| | | | |
|---|---|---|---|
| 762,274 | 6/1904 | Bourseau | 137/505.25 |
| 1,078,487 | 11/1913 | Dickey | 124/70 X |
| 1,404,689 | 1/1922 | Fairweather | 124/73 X |
| 2,097,866 | 11/1937 | Tomlinson | 124/67 |
| 2,623,226 | 12/1952 | Jones et al. | 15/104.062 |
| 2,755,815 | 7/1956 | Erle | 137/505.25 X |
| 2,980,096 | 4/1961 | Merz | 124/74 |
| 3,272,220 | 9/1966 | Frania et al. | 137/505.25 X |
| 3,612,026 | 10/1971 | Vadas et al. | 124/76 |
| 3,824,981 | 7/1974 | Crane et al. | 124/76 |
| 3,972,345 | 8/1976 | Court | 137/490 |
| 3,995,656 | 12/1976 | Mills | 137/505.25 X |
| 4,226,257 | 10/1980 | Trinkwalder | 137/505.25 X |
| 4,304,213 | 12/1981 | Jereckos | 124/70 X |
| 4,602,608 | 7/1986 | Lacam et al. | 124/76 X |
| 4,616,622 | 10/1986 | Milliman | 124/73 |
| 4,936,282 | 6/1990 | Dobbins et al. | 124/74 |
| 5,265,582 | 11/1993 | Bhogal | 124/73 |
| 5,280,778 | 1/1994 | Kotsiopoulos | 124/73 |
| 5,494,024 | 2/1996 | Scott | 124/73 |

FOREIGN PATENT DOCUMENTS

| | | |
|---|---|---|
| 440428 | 8/1991 | European Pat. Off. . |
| 467089 | 1/1992 | European Pat. Off. . |

*Primary Examiner*—John A. Ricci

*Attorney, Agent, or Firm*—A. Jose Cortina; John T. Winburn

[57] ABSTRACT

An improved paint ball gun and improved rotary breech, regulator, control valve, power piston and power valve assemblies for utilization in paint ball guns or related devices. The paint ball gun eliminates moving metal to metal surfaces to provide a consistent operation and easy regulation. The paint ball gun has a rotary breech to minimize damage to paint balls utilized in the paint ball guns.

9 Claims, 10 Drawing Sheets

10
54
59
43
52
38
50
26
40
48
44
46
42
30
32
34
37
37
36
24
28
88
83
83
88
82
84
86
86
74
76
78
56
80
90
60
72
92
106
108
110
64
70
112
68
114
62
70
58
116
66

PAINT BALL GUN AND ASSEMBLIES THEREFOR

This application is a continuation of application Ser. No. 07/972,619, filed Nov. 6, 1992 now U.S. Pat. No. 5,494,024.

BACKGROUND OF THE INVENTION

The present invention relates generally to paint ball guns and more particularly to an improved paint ball gun and an improved rotary breech, regulator, control valve, power piston and power valve assemblies for utilization therein.

Numerous types of paint ball guns have been developed for utilization in various manners, such as in simulated war games. These paint ball guns generally include a $CO_2$ cartridge or cylinder which is utilized as the power source to propel paint balls, generally at a specified velocity, such as three hundred (300) feet per second. In general, the prior art paint ball guns include a typical firearm type mechanism including a bolt, spring and cocking handle. This standard configuration is not conducive to efficient operation of the paint ball guns.

These prior art paint ball guns generally do not operate at low ambient temperatures below about forty (40) degrees Fahrenheit. These paint ball guns have metal or metallic moving parts which require lubrication and preventive maintenance. The bolt type mechanism also leads to breakage of the paint balls themselves. The prior art paint ball guns generally do not include pressure regulators. One prior art paint ball gun includes a regulator which is of a conventional configuration including a heavy main spring adjusted by a screw bearing against the spring. If the screw is removed while the paint ball gun is under pressure, the regulator can be ejected under pressure causing potential injury.

It therefore would be desirable to provide an improved paint ball gun which eliminates lubricants and metal on metal surfaces, has pressure regulation and which will operate consistently and at low ambient temperatures. Further it also would be desirable to provide an improved rotary breech, regulator, control valve, power piston and power valve assemblies for utilization in paint ball guns and in other devices.

SUMMARY OF THE INVENTION

The present invention provides an improved paint ball gun which operates consistently, at low temperatures and is easily regulated. The moving parts of the paint ball gun do not have metal to metal surfaces and hence eliminate lubrication. The paint ball gun includes a pressure regulator and also operates at low gas operating pressures with minimal damage to the paint balls themselves. The paint ball gun has a rotary breech to eliminate the prior art bolts and spring assemblies. The improved paint ball gun rotary breech, regulator, control valve, power piston and power valve assemblies can be utilized in paint ball guns separately or together or in other type devices.

These and other features and advantages of the invention will be more readily apparent upon reading the following description of a preferred exemplified embodiment of the invention and upon reference to the accompanying drawings wherein:

Figure 1:
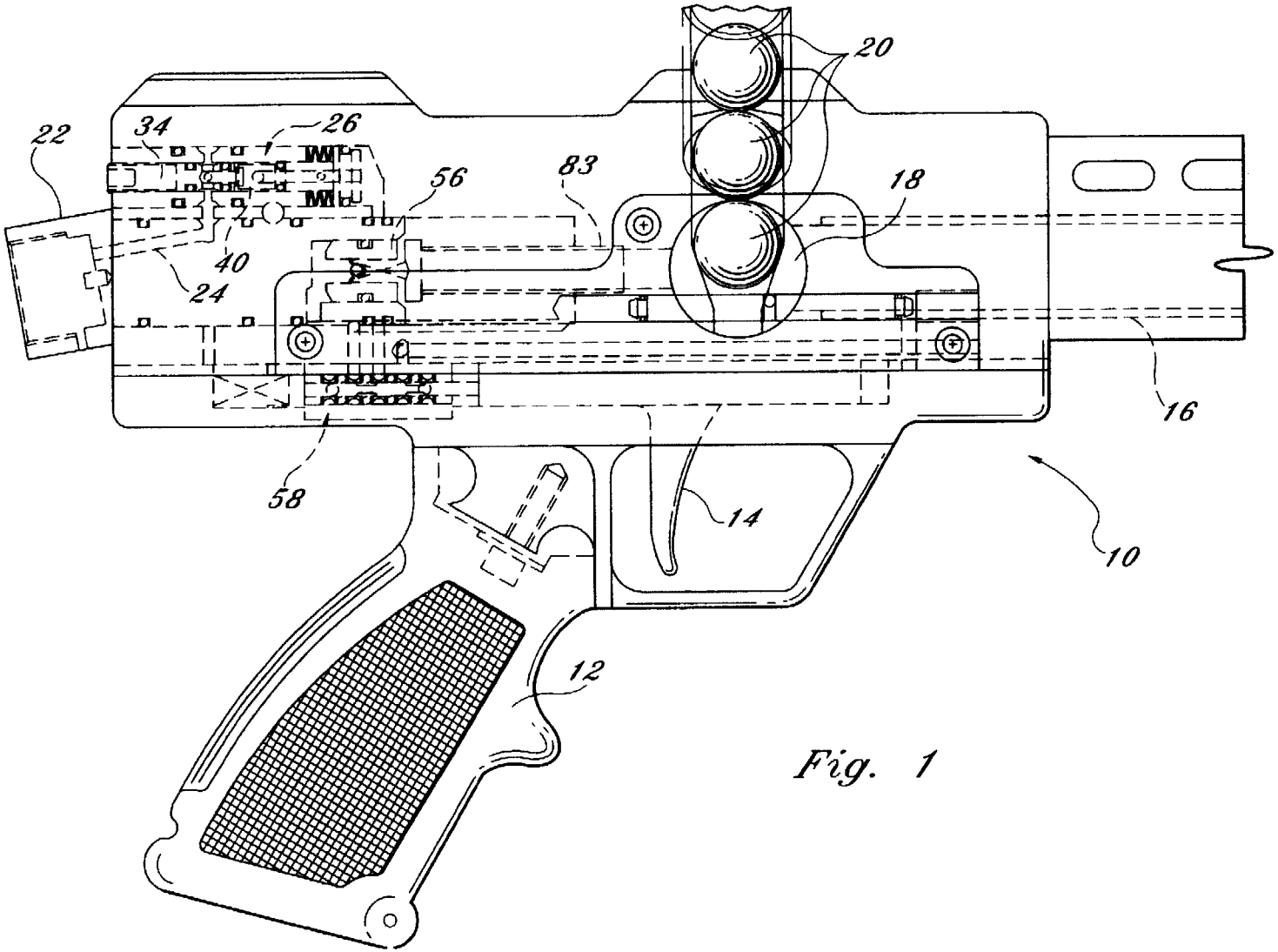
FIG. 1 is a partial side plan view, partially broken away, of one embodiment of the paint ball gun of the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Referring to FIGS. 1–4, an improved paint ball gun of the present invention is designated generally by the reference numeral 10. The paint ball gun includes a handle 12, a sliding trigger 14 and a barrel 16 (partially illustrated). The paint ball gun 10 includes a rotary breech assembly 18, into which is loaded one of a plurality of paint balls 20, one at a time, for firing through the barrel 16.

Figure 2:
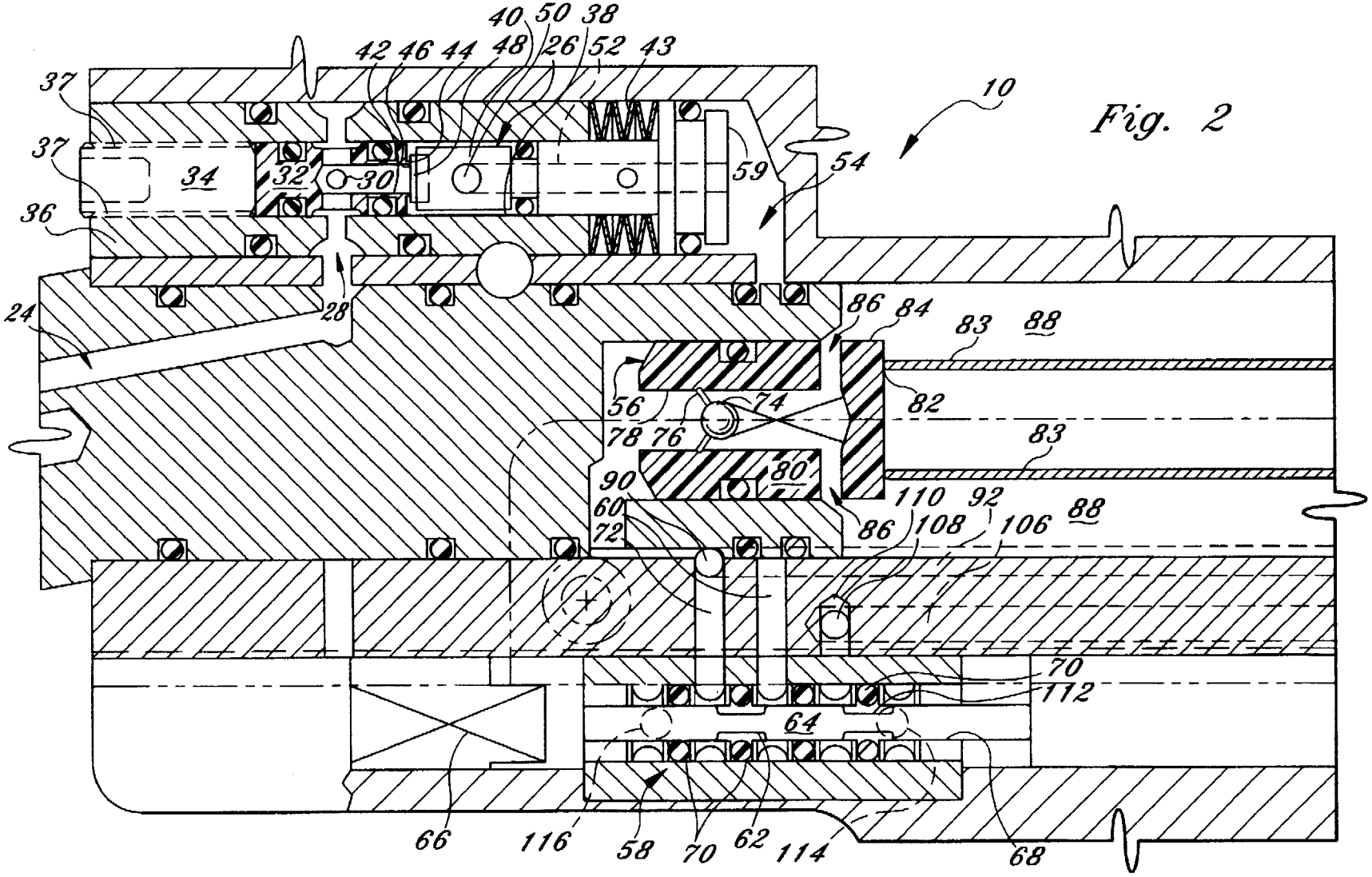
FIGS. 2 and 3 are an enlarged partial side views illustrating the operation of the paint ball gun of the present invention.
Figure 3:
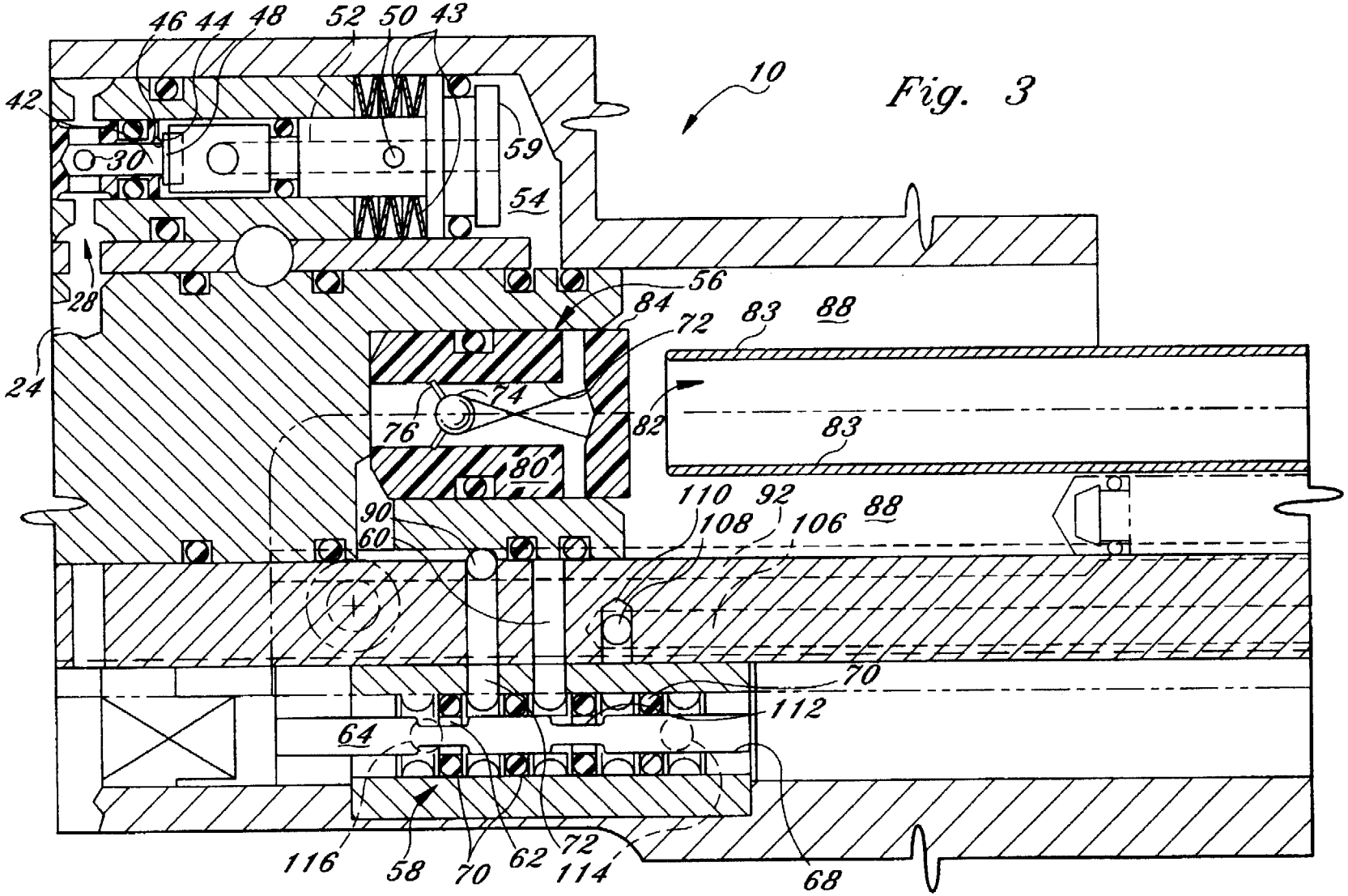
Figure 4:
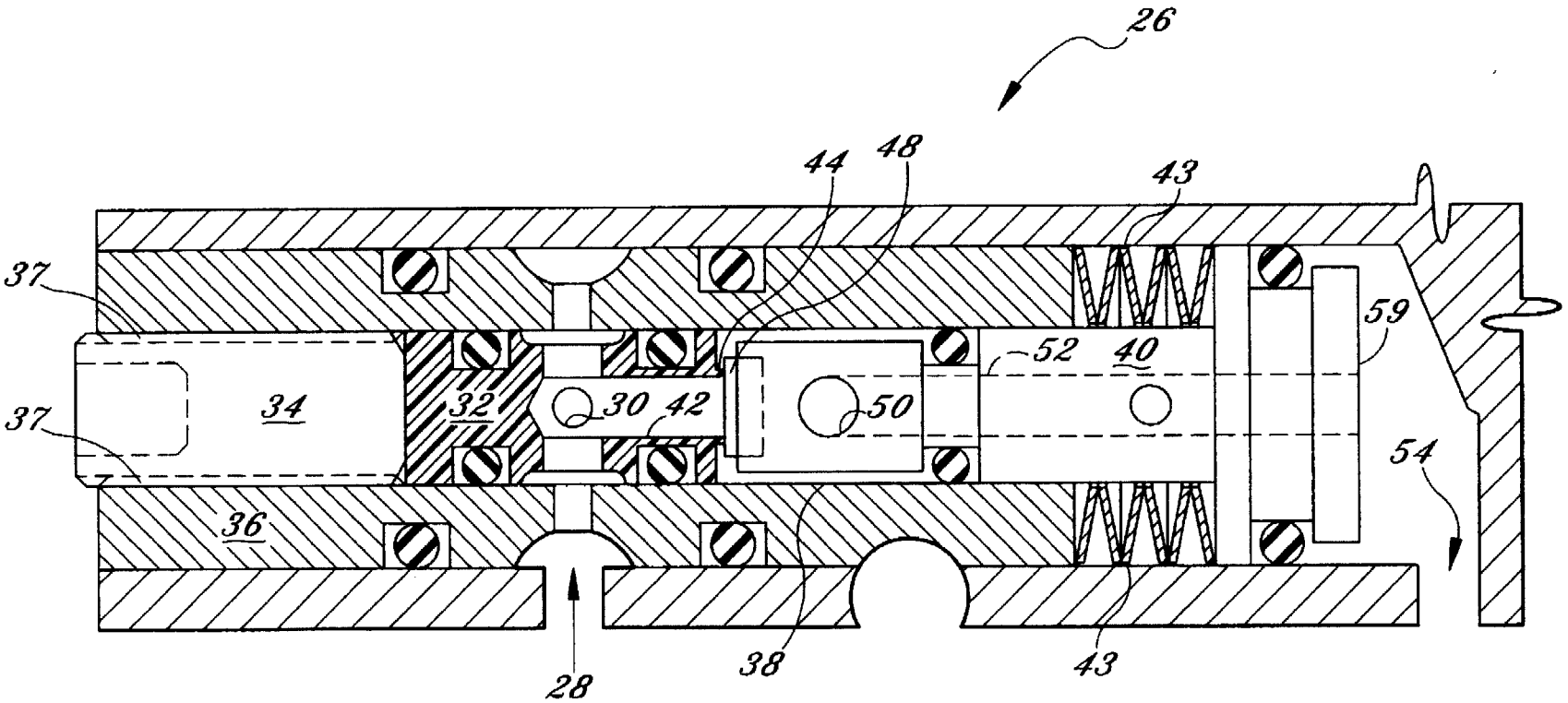
FIG. 4 is an enlarged side view of one embodiment of the paint ball gun regulator assembly of the present invention.

The paint ball gun 10 includes an adapter or seat 22 into which a standard $CO_2$ cartridge (not illustrated) is inserted to provide the operating power for the paint ball gun 10. As best illustrated in FIGS. 2–4, gas from the $CO_2$ cartridge enters a passageway 24 where it is fed to a regulator assembly 26. The gas enters the regulator 26 through a passageway 28 and an orifice 30 in a valve body 32. The lateral position of the valve body 32 controls the operating pressure of the paint ball gun 10. The position of the valve body 32 is controlled by a pressure adjusting screw 34, which is threadly mounted in a body portion 36 of the paint ball gun 10 in threads 37. The valve body 32 is mounted in a passageway 38 of the body portion 36. The valve body 32 has a diameter greater than the clearance between the threads 37. This difference in diameter prevents the valve body 32 from being ejected under pressure from the paint ball gun 10.

The passageway 38 also includes a piston 40 mounted therein. The gas passes through the orifice 30 into an axial outlet passageway 42 in the valve body 32. A spring 43 biases the piston 40 away from a lip 44 formed around an open end 46 of the passageway 42. With the piston 40 moved away from the lip 44, a seal formed by a disc 48, such as formed from urethane and mounted on or formed with the piston 40, pressing against the lip 44 is broken.

The gas passes out of the passageway 42 around the piston 40 and into a lateral inlet orifice 50 which couples the gas to a lateral passageway 52 formed in the piston 40. The gas then flows out of the passageway 52 through a passageway 54 and around a power piston assembly 56 to a control valve assembly 58.

The regulator 26 thus initially allows the gas to pass freely therethrough. As the gas pressure builds in the paint ball gun 10, as described in detail hereinafter, the gas exerts pressure on a face 59 of the piston 40 to close the regulator 26. The amount of gas pressure necessary to close the regulator 26 by pressing the piston 40 against the spring 43 and against the lip 44 is regulated by the adjusting screw 34. As the adjusting screw 34 is moved to the left, the operating pressure is increased and the spring 43 must be further compressed. As the adjusting screw 34 is moved to the right, the operating pressure is decreased, since the spring 43 is less compressed, before the piston 40 seals against the lip 44. Since the gas passes through the orifice 30 and the passageway 42, it cannot exhaust out of the paint ball gun 10 if the adjusting screw 34 is removed. This provides a significant safety advantage over the prior art regulators.

The gas flows into the control valve 58 through a passageway 60. The control valve 58 is illustrated in the fill/load position in FIG. 2 and the gas flows through a lateral reduced area passageway 62 in a control valve body 64. The control valve body 64 is biased into the fill (non-fire) position by a bias or return spring 66. The control valve body 64 is sealingly mounted in a passageway 68 by a plurality of O-rings 70 formed from synthetic resin polymers, such as sold under the trademark Teflon. The O-rings 70 form barriers to prevent gas flow along the valve body 64 in the passageway 68.

The gas flows from the passageway 62 into a passageway 72 and releases a ball type check valve 74 from a seat 76 (illustrated as seated in FIG. 2). The seat 76 is formed in a passageway 78 which is formed in a body 80 of the power piston 56. The gas pushes the power piston body 80 against an inlet end 82 of a power tube 83 which is coupled to the barrel 16. The power piston body 80 includes a seal 84 mounted thereto or formed therewith, also preferably formed of a synthetic resin polymer material, which seals the barrel 16 from the gas. The gas passes out of a passageway or passageways 86 into a gas or power chamber 88 formed around the power tube 83.

At the same time as the gas fills the power chamber 88, a portion of the gas flows through a port 90 formed in the passageway 72, where it flows into a passageway 92. The gas flows through the passageway 92 to the rotary breech 18 as illustrated in FIGS. 5–7.

Figure 5A:
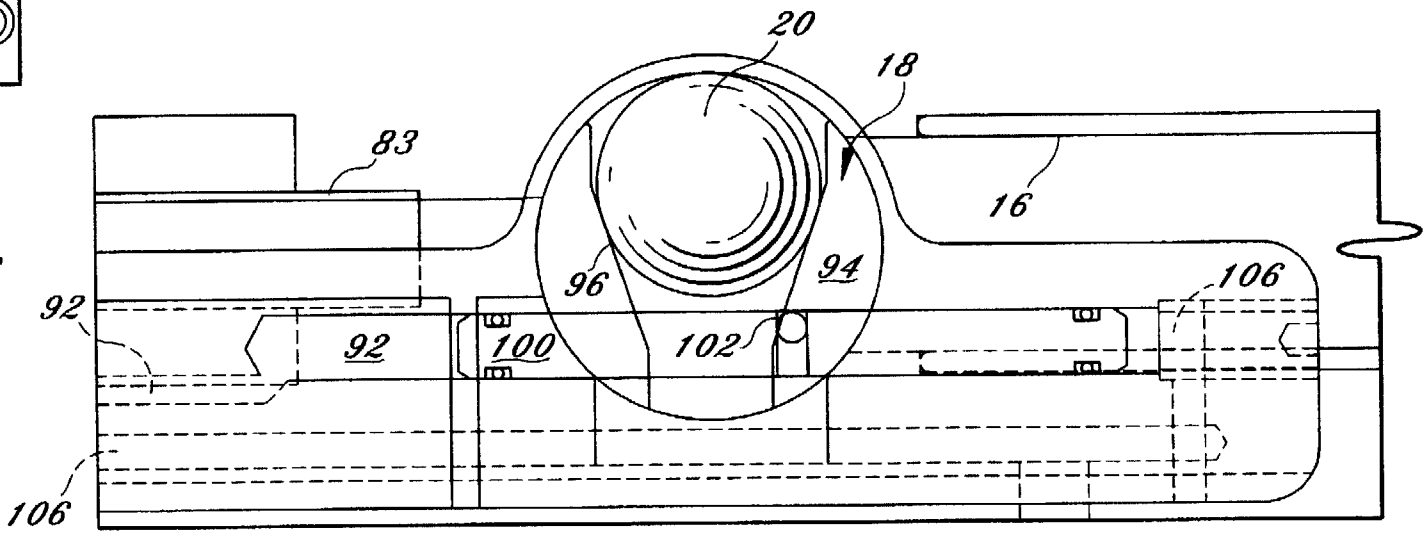
FIGS. 5A–5C and 6A–6C are side views illustrating the loading and firing of the paint balls.
Figure 5C:
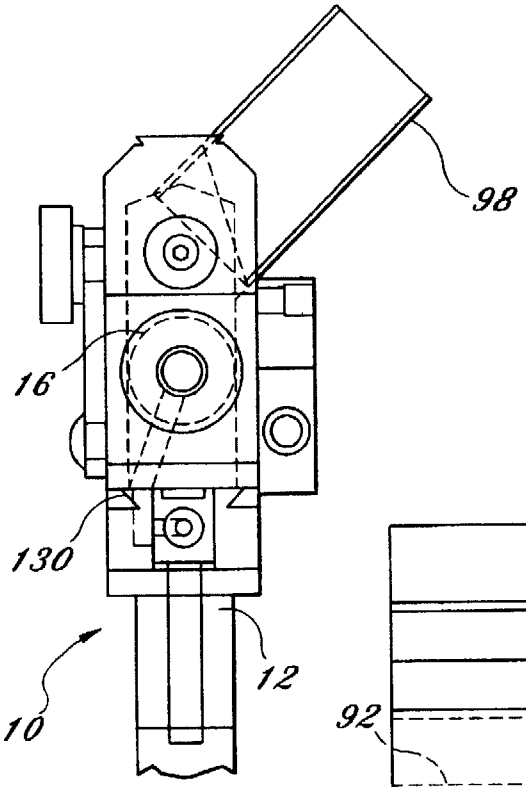
Figure 5B:
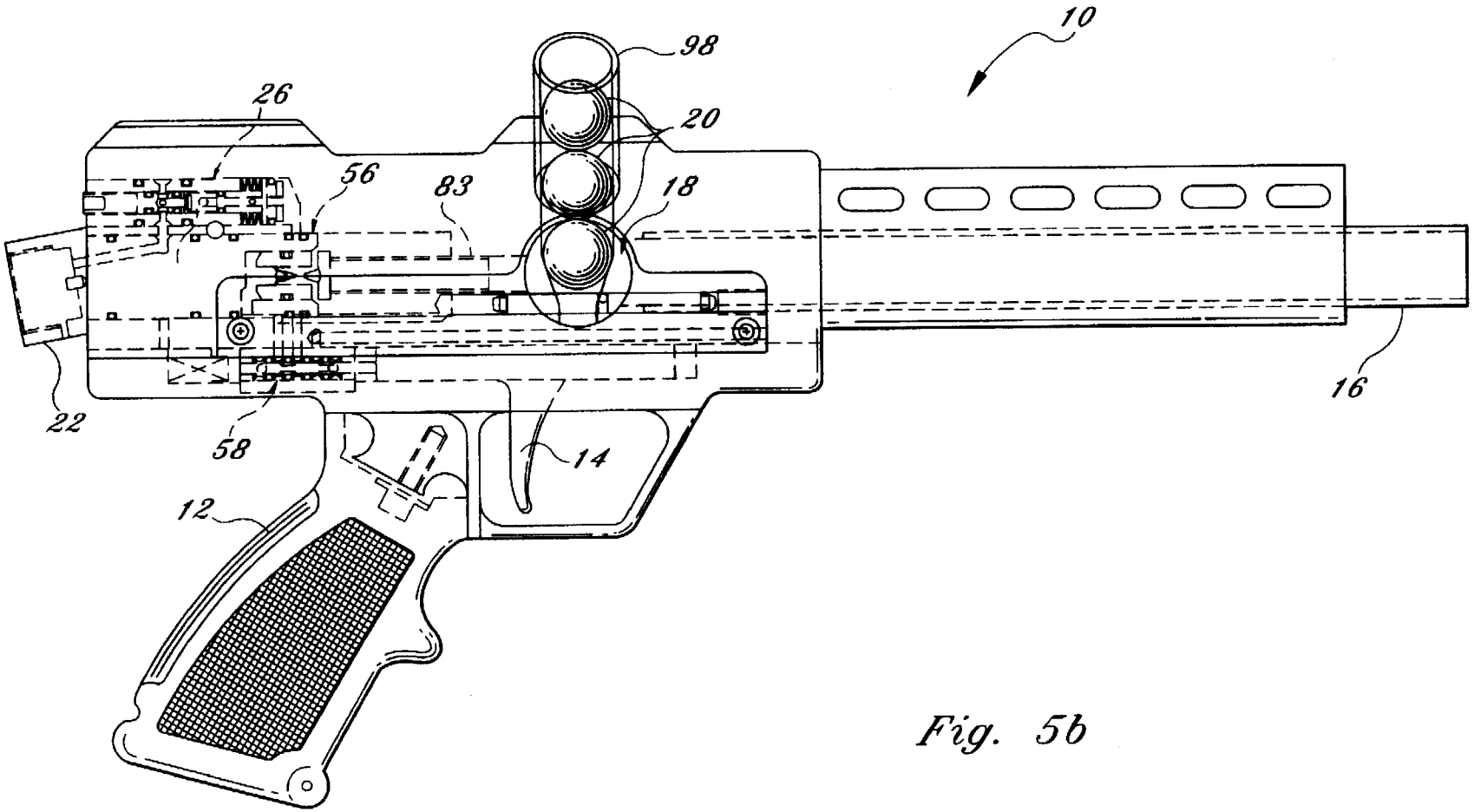

The rotary breech 18 is first moved into the load position as illustrated in FIGS. 5A–5C. The rotary breech 18 includes a rotating body 94 having a paint ball receiving breech portion 96. In the load position, one of the paint balls 20 is loaded from a paint ball cartridge or tube 98 into the breech portion 96. The gas in the fill position flows through the passageway 92 behind a first piston 100. The piston 100 operates against a pivot pin 102 which moves laterally to rotate the rotary breech 18 into the load position. At the same time a second piston 104 is moved to exhaust gas through a passageway 106, through a lateral orifice 108 (FIG. 2), a passageway 110, a lateral passageway 112 and out through an exhaust orifice 114 formed in the control valve body 64.

Figures 6A, 6C:
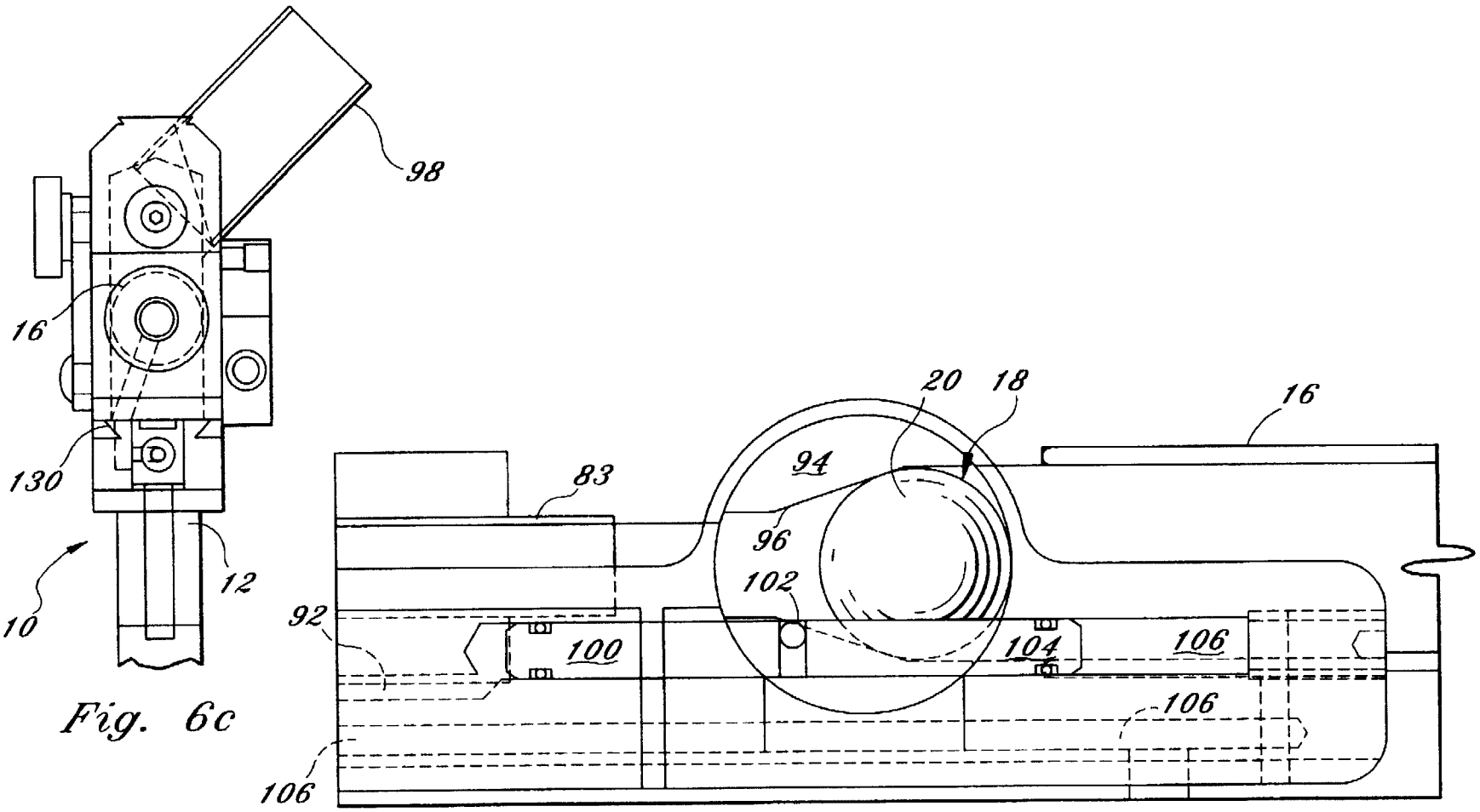
Figure 6B:
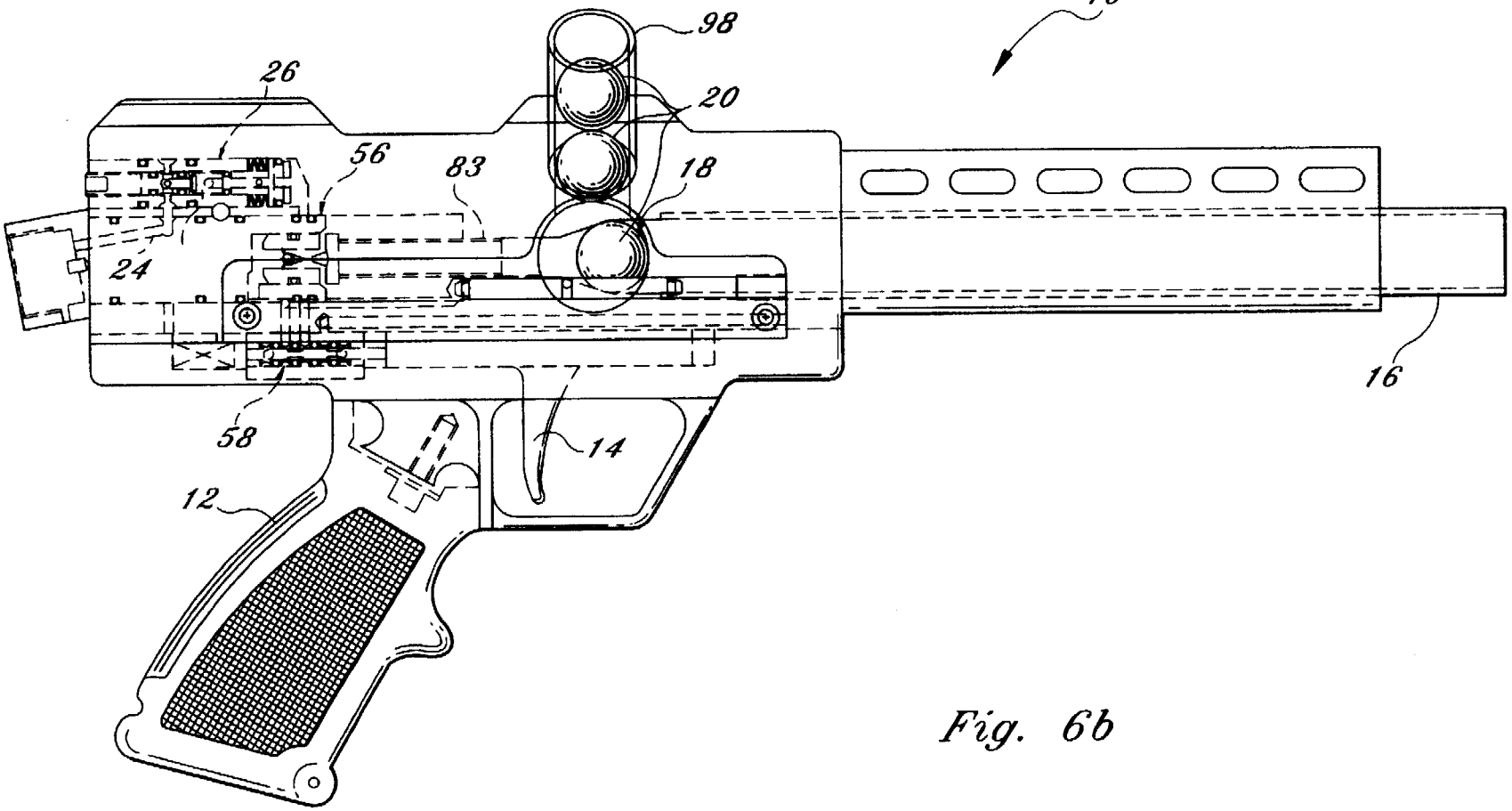
Figure 7:
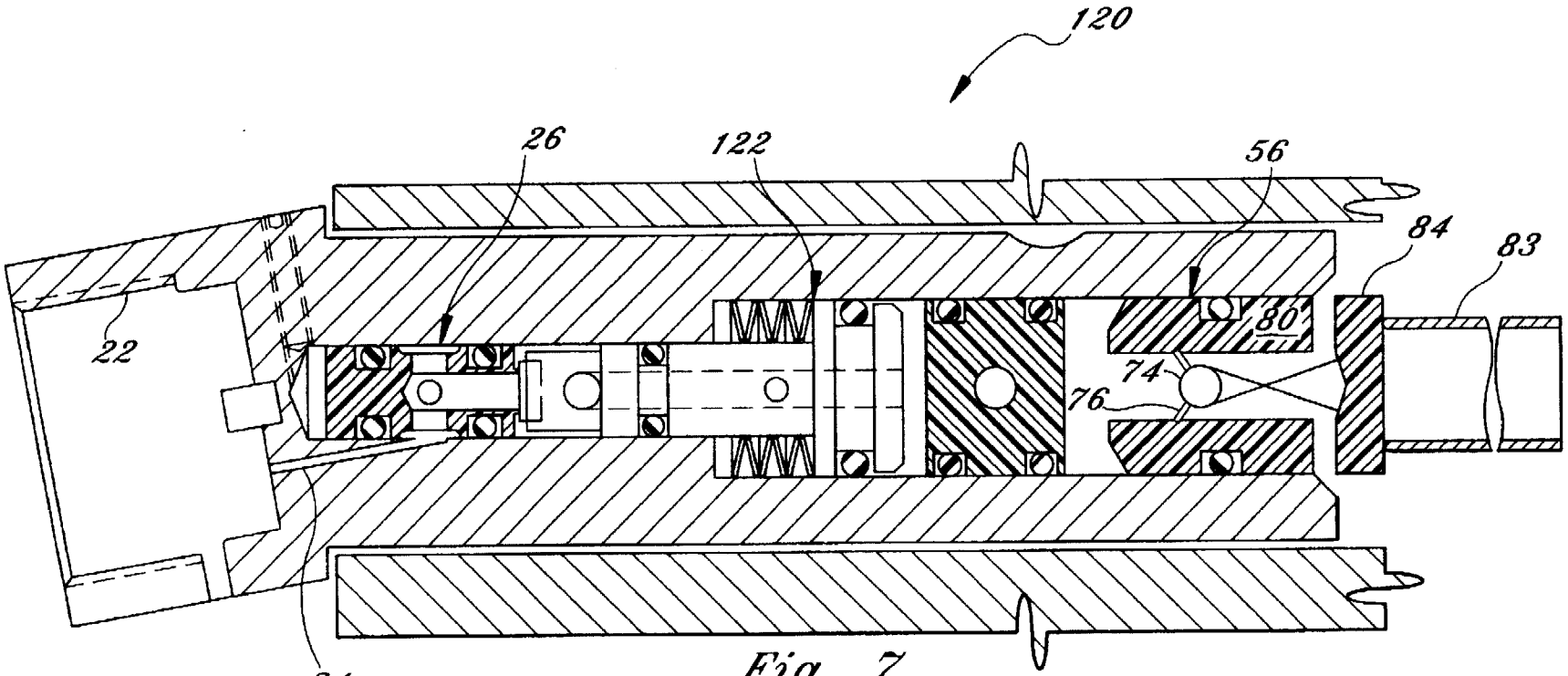
FIG. 7 is another embodiment of a power valve assembly of the present invention.
Figure 8A:
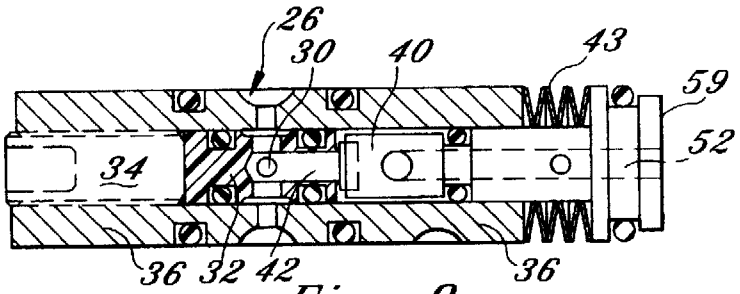
FIG. 8A–8D are side plan views of the individual regulator, power valve, rotary breech and control valve assemblies of the present invention.
Figure 8B:
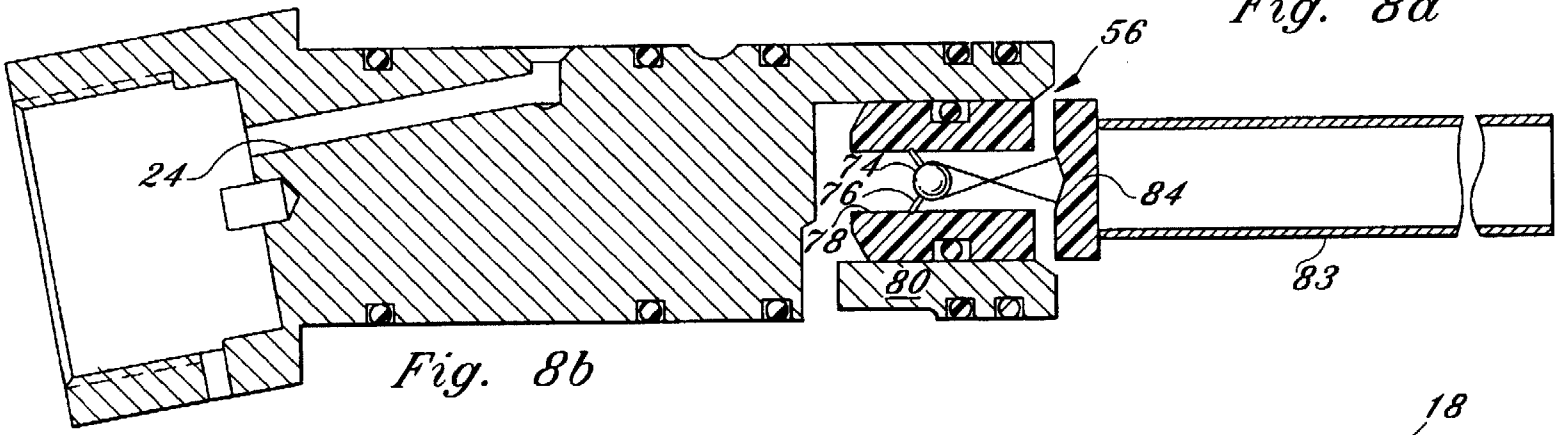
Figure 8C:
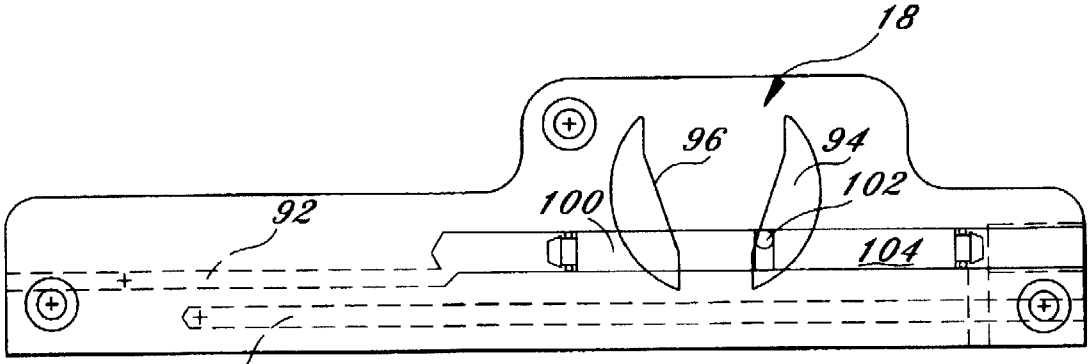
Figure 8D:
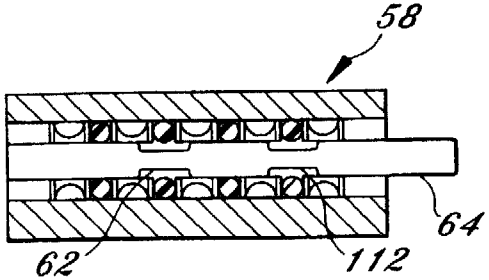

The trigger 14 is depressed to fire the paint ball gun 10, as illustrated in FIGS. 3, 6 and 7. The depression of the trigger 14 moves the control valve body 64 against the return spring 66. The gas in the passageway 60 now flows through the passageway 112 into the passageway 110, through the orifice 108 and into the passageway 106. The gas in the passageway 106 pushes against the piston 104, which moves the pivot pin 102 and rotates the rotary breech 18 into the firing position, as illustrated in FIGS. 6A–6C. The paint ball 20 now is aligned with the power tube 83 and the barrel 16 for firing therethrough. The non-spring gas operated rotary action of the rotary breech 18 virtually eliminates breakage of the paint balls 20.

The gas behind the piston 100 exhausts through the passageway 92, the port 90 (FIG. 3), the passageway 72, the passageway 62 and through an exhaust port 116 formed in the control valve body 64. At the same time, the gas behind the power piston 56 exhausts also through the passageway 72, 62 and the port 116. The check valve 74 then seats against the seat 76 and the power piston body 80 moves away from the power tube 83, releasing the seal 84 and rapidly emptying the gas from the chamber 88 into and out the power tube 83, firing the paint ball 20 through the barrel 16.

The resultant pressure differential when the trigger 14 is depressed, causes the power piston 56 to snap back allowing the gas to exhaust quickly into the power tube 83 and propelling the paint ball 20 at a maximum efficiency. All of the gas pressure is utilized to propel the paint ball 20, since no springs are compressed with the firing gas pressure. The paint ball gun 10 will operate at pressures of below 150 psi although the operating pressure typically is about 500 psi. Other prior art types of paint ball guns typically require on the order of 2000 psi for the gas operating pressure and hence are much less efficient.

An in-line embodiment of a power valve assembly 120 of the present invention is illustrated in FIG. 7. The regulator 26 and the power piston 56 are formed in an in-line unit 122. The valving otherwise would be essentially the same as in the previous embodiment, but only the single unit 122 would need to be replaced or removed for repair, if needed. In this embodiment of the regulator 26, control of the gas pressure is achieved by adjusting the set screw shown in dashed lines (not numbered) is the same manner as with adjusting screw 34 of the embodiment of FIG. 4.

Enlarged separate views of the regulator 26, the power piston 56, the control valve 58 and the rotary breech assemblies 18 are illustrated in FIGS. 8A–8D. The improved rotary breech 18, regulator 26, power piston 56 and control valve 58 are described herein utilized together in the paint ball gun 10, however the assemblies can be provided separately in other paint ball guns or in related devices. The regulator 26, for example, can be utilized in other compressed air environments, such as utilized in diving equipment. The power piston 56 can be utilized for any type of rapid evacuation of a volume of gas.

Modifications and variations of the present invention are possible in light of the above teachings. The power piston 56 preferably is formed from a composite polymer material, which forms an excellent seal with the power tube 83. The rotary breech 18 also preferably is formed from a composite material and therefore should not exhibit any significant wear. The sliding trigger 14 preferably is coated with a Teflon type polymer, such as sold under the trade name "XLEN". Also, as illustrated in FIGS. 5A and 6A, a further safety feature of the paint ball gun 10 of the present invention is provided by a dove tail construction 130, which prevents the control valve 58 and the trigger 14 from inadvertently ejecting from the paint ball gun 10 under gas pressure. It is therefore to be understood that within the scope of the appended claims, the invention may be practiced other than is specifically described.

I claim as my invention:

1. An improved paint ball gun having a barrel and adapted to be coupled to a source of gas pressure, comprising:

means for regulating the gas pressure, said means for regulating including a laterally movable piston biased into an open position and being movable into a closed position in response to a predetermined operating gas pressure being attained for forcing said movable piston into said closed position, and means for regulating said operating gas pressure by adjusting the lateral location of the closed position for said piston;

means for coupling said gas pressure from said regulating means to a pressure chamber in a loading position;

means for loading a paint ball into the barrel, said means for loading said paint ball gun being operable to achieve said loading as a result of gas pressure applied thereto, and means for triggering said gas pressure from said pressure chamber into said barrel to propel said paint ball through said barrel directly as a result of said gas pressure thereon.

2. The paint ball gun as defined in claim 1 including means for preventing said piston from ejecting from said paint ball gun if said means for regulating is removed from said paint ball gun.

3. An improved paint ball gun having a barrel and adapted to be coupled to a source of gas pressure, comprising:

means for coupling said gas pressure into a pressure chamber in a loading position;

means for loading a paint ball into the barrel, said means for loading said paint ball gun being operable to achieve said loading as a result of gas pressure applied thereto;

means for triggering said gas pressure from said pressure chamber into said barrel to propel said paint ball through said barrel directly as a result of said gas pressure thereon; and valving means for coupling said gas pressure to said paint ball loading means to move said paint ball loading means into said loading position and for coupling said gas pressure from said triggering means to move said paint ball loading means into a firing position for firing said paint bail.

4. The paint ball gun as defined in claim 3 wherein said valving means include a laterally movable valve body for coupling said gas pressure to said paint ball loading means.

5. The paint ball gun as defined in claim 3 including means for regulating the gas pressure.

6. An improved gas regulator assembly mountable in a housing and adapted to be coupled to a source of gas pressure, comprising:

means for regulating the gas pressure including laterally movable piston biased into an open position and being movable into a closed position inresponse to a predetermined operating gas pressure being attained for forcing said movable piston into said closed position, and means for controlling said operating gas pressure by adjusting the lateral location of the closed position for said piston.

7. The regulator as defined in claim 6 including means for preventing said piston from ejecting from said housing if said regulating means are removed from said housing.

8. The regulator as defined in claim 7 wherein said piston is biased into said open position by spring means bearing against said piston, and said piston having a gas passageway therethrough, and said piston being movable to said closed position by having a face of said piston exposed to said operating gas pressure to cause movement of said piston against said spring means to close said gas passageway upon obtaining said operating pressure.

9. An improved paint ball gun having a barrel and adapted to be coupled to a source of gas pressure, comprising:

means for regulating the gas pressure;

means for coupling said gas pressure from said regulating means to a pressure chamber in a loading position;

means for loading a paint ball into the barrel, said means for loading said paint ball gun being operable to achieve said loading as a result of gas pressure applied thereto;

valving means for coupling said gas pressure to said paint ball loading means for moving said paint ball loading means into said loading position, and for coupling said gas pressure from said triggering means to move said paint ball loading means into a firing position for firing said paint ball; and means for triggering said gas pressure from said pressure chamber into said barrel to propel said paint ball through said barrel directly as a result of said gas pressure thereon.

* * * * *

US005669369C1

(12) REEXAMINATION CERTIFICATE (4650th)

United States Patent

Scott

(10) Number: US 5,669,369 C1

(45) Certificate Issued: *Oct. 1, 2002

(54) PAINT BALL GUN AND ASSEMBLIES THEREFOR

(75) Inventor: Eric Scott, 15695 92nd Way N., Jupiter, FL (US) 33478

(73) Assignee: Eric Scott, Jupiter, FL (US)

Reexamination Request:
No. 90/005,761, Jun. 26, 2000

Reexamination Certificate for:

| | |
|---|---|
| Patent No.: | **5,669,369** |
| Issued: | **Sep. 23, 1997** |
| Appl. No.: | **08/607,134** |
| Filed: | **Feb. 26, 1996** |

( * ) Notice: This patent is subject to a terminal disclaimer.

Related U.S. Application Data

(63) Continuation of application No. 07/972,619, filed on Nov. 6, 1992, now Pat. No. 5,494,024.

(51) Int. Cl.[7] ..... F41B 11/32; F41B 11/06

(52) U.S. Cl. ..... 124/73; 124/74; 137/505.25

(58) Field of Search ..... 124/56, 70–74, 124/76; 137/505.25; 251/360, 363

(56) References Cited

U.S. PATENT DOCUMENTS 4,181,139 A 1/1980 Martini

*Primary Examiner*—Darren W. Ark

(57) ABSTRACT

An improved paint ball gun and improved rotary breech, regulator, control valve, power piston and power valve assemblies for utilization in paint ball guns or related devices. The paint ball gun eliminates moving metal to metal surfaces to provide a consistent operation and easy regulation. The paint ball gun has a rotary breech to minimize damage to paint balls utilized in the paint ball guns.

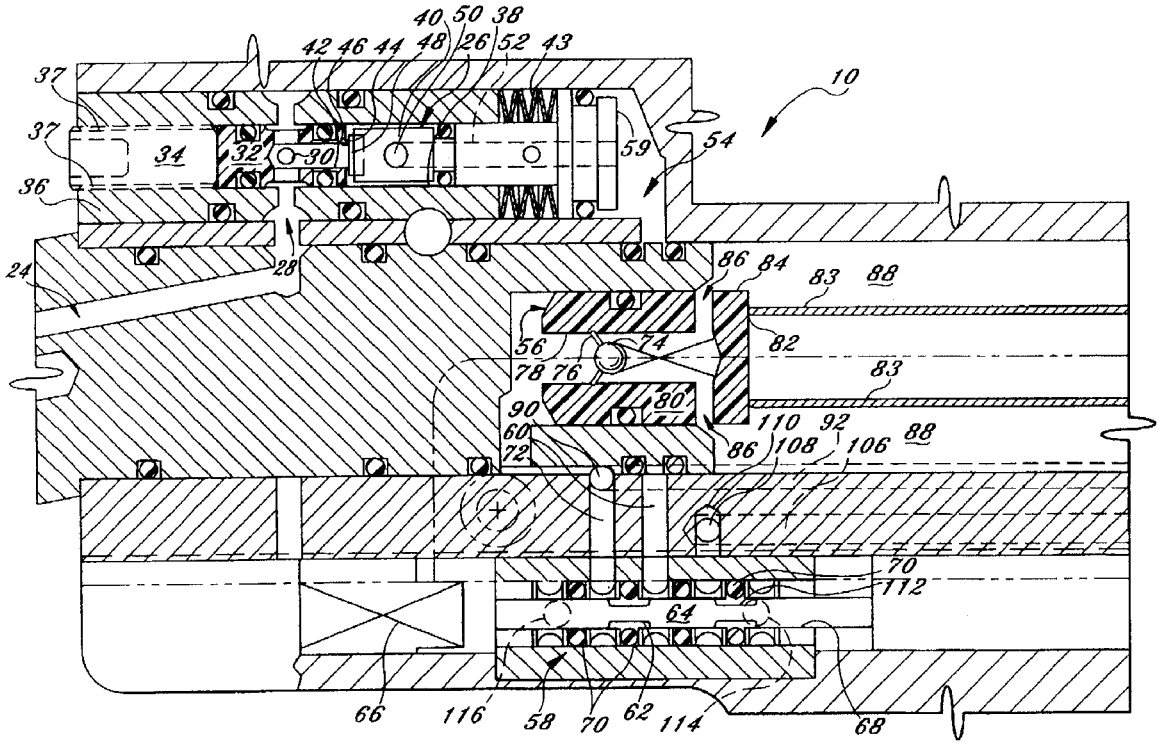

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–5 and 9 is confirmed.

Claim 7 is cancelled.

Claim 6 is determined to be patentable as amended.

Claim 8, dependent on an amended claim, is determined to be patentable.

New claims 10 and 11 are added and determined to be patentable.

6. An improved gas regulator assembly mountable in a housing and adapted to be coupled to a source of gas pressure, comprising:

means *including a valve body* for regulating the gas pressure including [laterally] *an axially* movable piston biased into an open position and being movable into a closed position [inresponse] *in response* to a predetermined operating gas pressure being attained for forcing said movable piston into said closed position, and means for controlling said operating gas pressure by adjusting the [lateral] *axial* location of the closed position [for] *of* said piston, *said means for controlling said operating gas pressure including an adjustable screw threadably attachable to threads formed in a bore formed in said housing and accessible externally thereof for changing the level of the operating gas pressure, a diameter of said piston being larger than a diameter of said threads formed in said housing to prevent said piston from ejecting from said housing if said adjusting screw is removed from said housing.*

*10. An improved gas regulator assembly mountable in a housing and adapted to be coupled to a source of gas pressure, comprising:*

*means including a valve body for regulating the gas pressure including an axially movable piston biased into an open position and being movable into a closed position in response to a predetermined operating gas pressure being attained for forcing said movable piston into said closed position, and means for controlling said operating gas pressure by adjusting the axial location of the closed position of said piston, said means for controlling said operating gas pressure including an adjustable screw threadably attachable to threads formed in a bore formed in said housing and accessible externally thereof for changing the level of the operating gas pressure, said adjustable screw being disposable in said bore formed angularly with respect to said valve body, said valve body having a contoured shaped end portion, said adjustable screw having a contoured shaped end portion in cooperation with the end portion of the valve body for adjusting the axial location of the closed position of said piston whereby said piston will not become dislodged from said bore in the event said adjustable screw is removed.*

*11. An improved gas regulator assembly as claimed in claim 10 wherein said adjusting screw includes a tool receiving end formed on the end accessible from the exterior of said housing whereby the adjusting screw is adjusted to change the pressure of the pressure regulator assembly.*

* * * * *